US008434929B2

(12) United States Patent
Liu et al.

(10) Patent No.: US 8,434,929 B2
(45) Date of Patent: May 7, 2013

(54) SOLDER PASTE MIXER

(75) Inventors: Yu-Ching Liu, New Taipei (TW); Fu-Chi Yang, New Taipei (TW); Chi-An Yu, New Taipei (TW); Xi-Hang Li, Shenzhen (CN); Bing Liu, Shenzhen (CN); Jing-Bin Liang, Shenzhen (CN); Hai-Gui Huang, Shenzhen (CN); Xue-Bing Bao, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/207,454

(22) Filed: Aug. 11, 2011

(65) Prior Publication Data

US 2012/0218853 A1 Aug. 30, 2012

(30) Foreign Application Priority Data

Feb. 28, 2011 (CN) ..... 2011 1 0047617

(51) Int. Cl.
*B01F 11/00* (2006.01)
*B01F 11/02* (2006.01)

(52) U.S. Cl.
USPC ..... 366/110; 366/118; 366/127; 366/215; 366/216

(58) Field of Classification Search ..... 366/215, 366/216, 218, 108, 197, 219, 111, 143, 145, 366/217, 343, 110, 127, 118
See application file for complete search history.

(56) References Cited

U.S. PATENT DOCUMENTS

| | | | | |
|---|---|---|---|---|
| 3,500,993 | A * | 3/1970 | Tarzian | 366/110 |
| 4,125,335 | A * | 11/1978 | Blume et al. | 366/209 |
| 4,921,356 | A * | 5/1990 | Bordenga | 366/343 |
| 5,052,812 | A * | 10/1991 | Tannenbaum et al. | 366/209 |
| 5,427,451 | A * | 6/1995 | Schmidt | 366/208 |
| 7,059,762 | B2 * | 6/2006 | Yi et al. | 366/208 |
| 8,201,987 | B2 * | 6/2012 | Carroll | 366/111 |
| 2008/0295704 | A1 * | 12/2008 | Rose et al. | 99/348 |
| 2009/0027997 | A1 * | 1/2009 | Meier | 366/281 |

FOREIGN PATENT DOCUMENTS

JP 2000233123 A * 8/2000

* cited by examiner

*Primary Examiner* — Tony G Soohoo
*Assistant Examiner* — Anshu Bhatia
(74) *Attorney, Agent, or Firm* — Altis Law Group, Inc.

(57) ABSTRACT

A solder paste mixer includes a housing, a vibration mechanism, a rotating mechanism, and a fixture for fixing a solder paste jar. The housing defines a receiving space, and the vibration mechanism and the rotating mechanism are retained within the receiving space. The fixture can be vibrated by the vibration mechanism and rotated by the rotating mechanism.

5 Claims, 4 Drawing Sheets

SOLDER PASTE MIXER

BACKGROUND

1. Technical Field

The present disclosure relates to solder paste mixers, and particularly to a solder paste mixer with a vibration mechanism and a rotating mechanism.

2. Description of Related Art

Generally, solder paste mixers are used to achieve better results with stencil printing and reflowing processes. A mixer rotates a solder paste jar, and thus the solder paste can be mixed to a liquid state. However, solder paste mixers only satisfy basic requirements, a new type of solder paste mixer is still needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure are now described in detail, with reference to the accompanying drawings.

Figure 1:
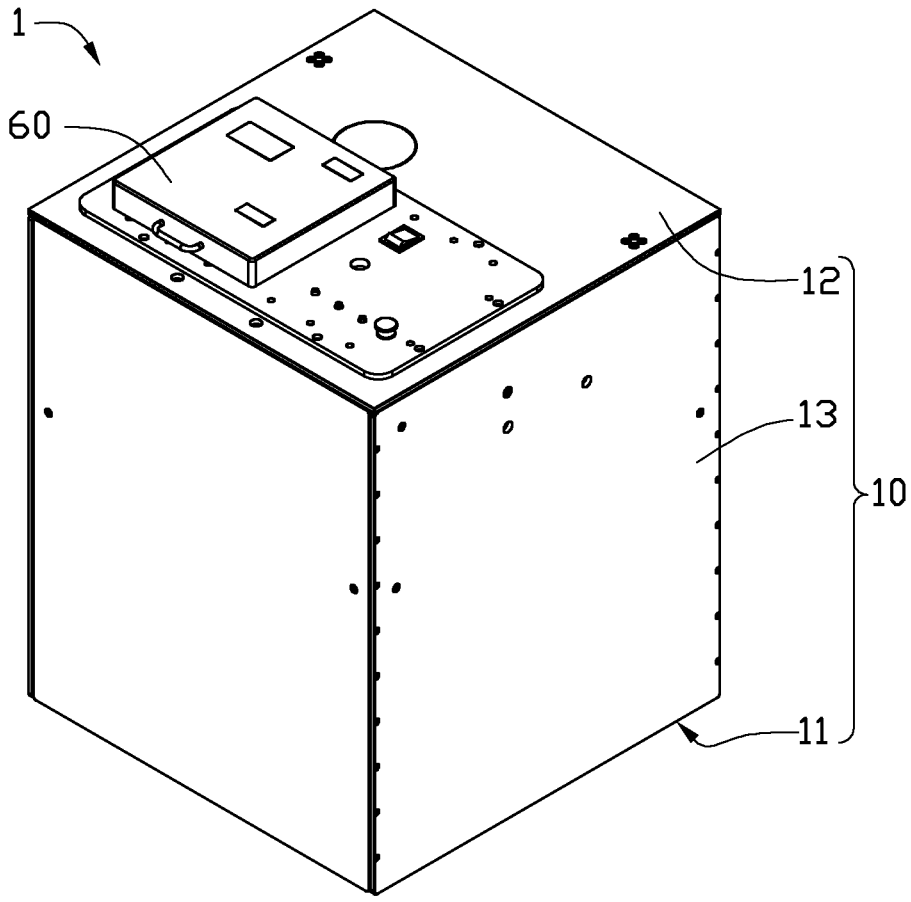
FIG. 1 is an isometric view of a solder paste mixer according to an exemplary embodiment showing a cover plate in a closed state.
Figure 2:
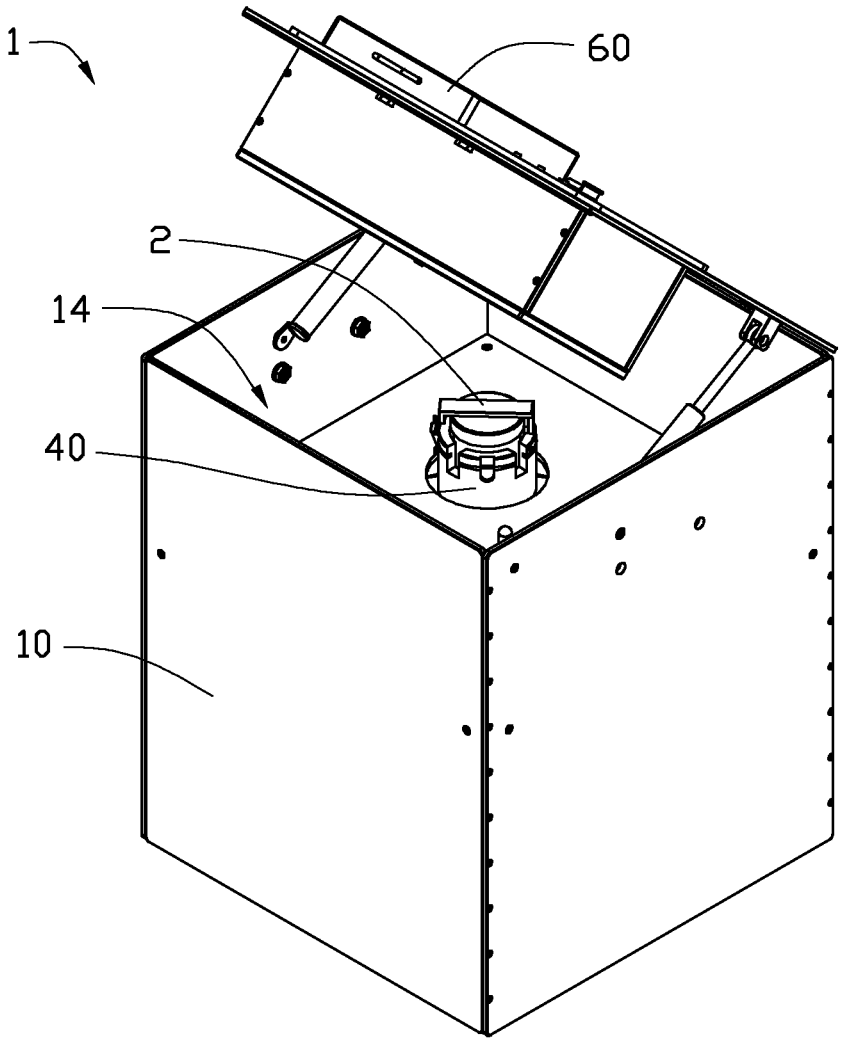
FIG. 2 is an isometric view of the solder paste mixer of FIG. 1, showing the cover plate in an open state.
Figure 3:
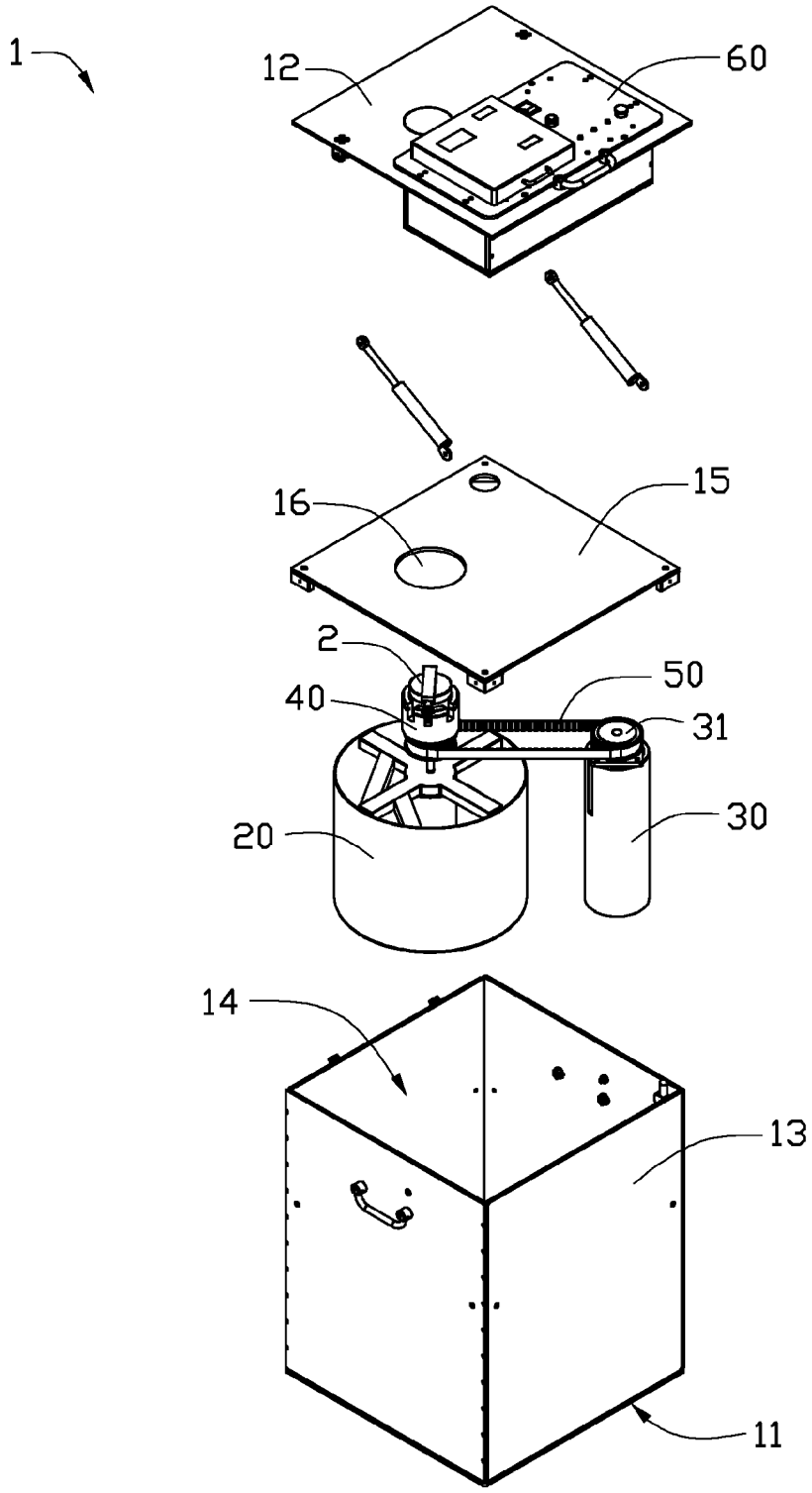
FIG. 3 is an exploded, isometric view of the solder paste mixer of FIG. 1.

Referring to FIGS. 1-3, a solder paste mixer 1 includes a housing 10, a vibration mechanism 20, a rotating mechanism 30, and a fixture 40 for fixing a solder paste jar 2. The fixture 40 can be vibrated by the vibration mechanism 20 and rotated by the rotating mechanism 30.

The housing 10 includes a bottom plate 11, a cover plate 12, and four side plates 13 extending from the bottom plate 11. The bottom plate 11 and the side plates 13 cooperatively define a receiving space 14. The cover plate 12 is rotatably connected to one of the side plates 13 for covering the receiving space 14. The housing 10 further includes a middle plate 15 that is arranged within the space 14. The middle plate 15 defines a through hole 16.

Figure 4:
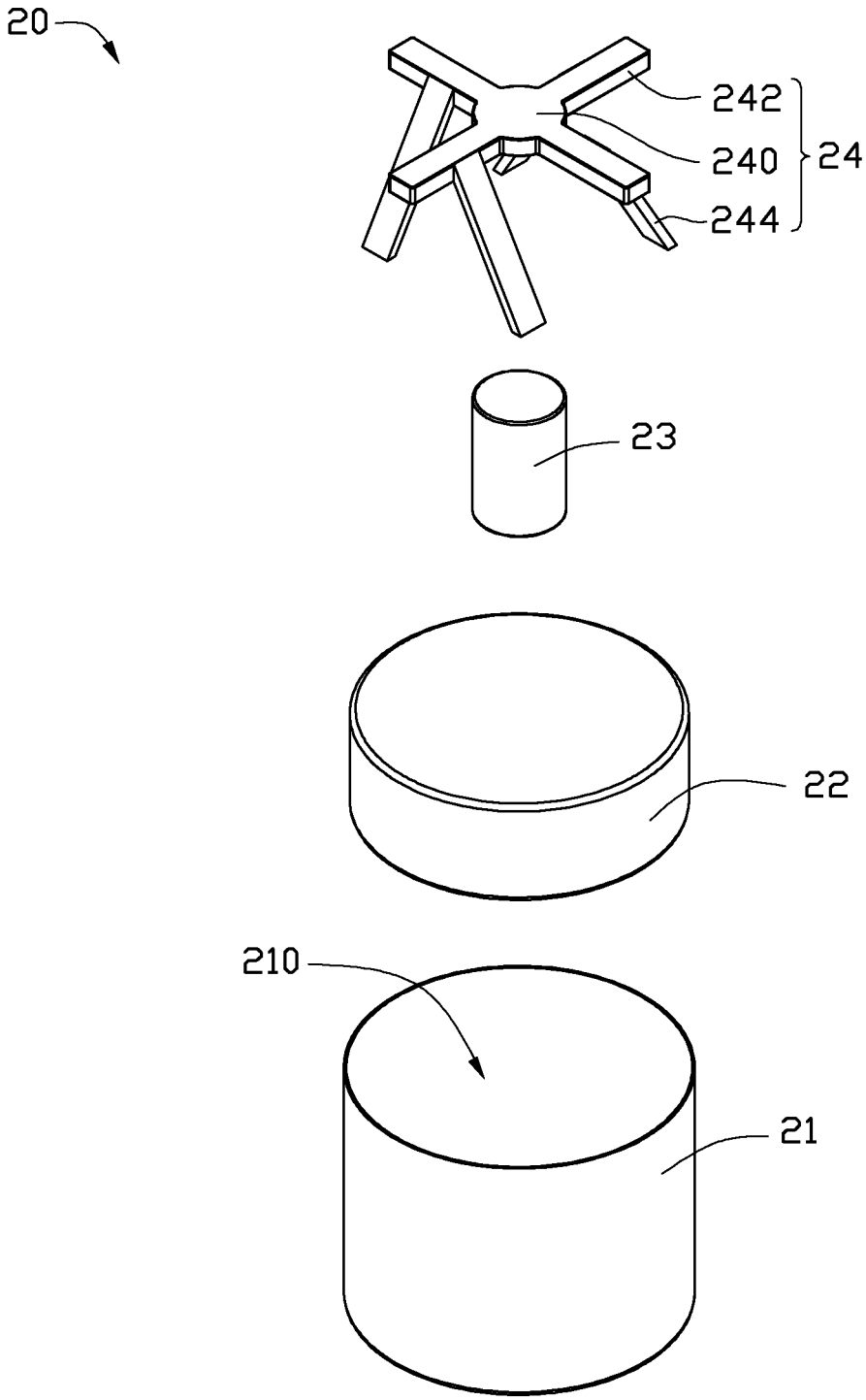
FIG. 4 is an exploded, isometric view of the vibration mechanism of the solder past mixer of FIG. 3.

Referring also to FIG. 4, the vibration mechanism 20 includes a hollow casing 21, a support member 22, an electromagnetic member 23, and a vibration member 24.

The hollow casing 21 is secured to the bottom plate 11 of the housing 10 and defines an accommodating space 210 for receiving the support member 22, the electromagnetic member 23, and the vibration member 24. The support member 22 is shaped corresponding to the accommodating space 210, and thus can be attached to a bottom of the hollow casing 21.

The electromagnetic member 23 is fixed on the support member 22. The electromagnetic member 23 can be made of any suitable electromagnetic material, such as iron with a coil of wire around it. The electromagnetic member 23 is connected to a power resource (not shown).

The vibration member 24 is made of material which can be attracted by the electromagnetic member 23. In the embodiment, the vibration member 24 includes a main body 240 aligned with the electromagnetic member 23 and four bars 242 radially extending from a lateral surface of the main body 240. Each bar 242 includes an elastic arm 244 extending therefrom. In the embodiment, each elastic arm 244 is inclined with respect to an imaginative plane defined by the bars 242. A distal end of the elastic arm 244 is always contacting the support member 22. When a voltage applied to the electromagnetic member 23 varies, the vibration member 24 vibrates a corresponding amplitude and frequency as attracted by the electromagnetic member 23 and resisted by the four elastic arms 244.

The rotating mechanism 30 can be a motor and includes a rotating output shaft 31.

The fixture 40 is disposed on the vibration member 24 and extends through the through hole 16 of the middle plate 15. The fixture 40 is rotatably connected to the output shaft 31 of the rotating mechanism 30 via a connecting means, such as a belt 50.

The solder paste mixer 1 further includes a control panel 60 fixed on the cover plate 12 of the housing 10. The control panel 60 is electrically connected to the vibration mechanism 20 and the rotating mechanism 30. The control panel 60 is used to control the operation parameters of the vibration mechanism 20 and the rotating mechanism 30, such as vibration amplitude, vibration frequency, rotating speed, and total running time.

In use, the solder paste jar 2 is fixed within the fixture 40, then vibrated by the vibration mechanism 20 and rotated by the rotating mechanism 30. Thus, the solder paste jar 2 can be mixed effectively and evenly to a liquid state.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A solder paste mixer comprising:

a housing defining a receiving space;

a vibration mechanism comprising a hollow casing defining an accommodating space, a support member secured to a bottom of the accommodating space, an electromagnetic member fixed to the support member, and a vibration member that is made of material capable of being attracted by the electromagnetic member, wherein the vibration member comprises a main body aligned with the electromagnetic member and a plurality of bars radially extending from a lateral surface of the main body, each bar comprises an elastic arm extending therefrom, and the elastic arm comprises a distal end always contacting the support member for supporting the vibrating member and capable of being elastically deformed when the vibration member being attracted by the electromagnetic member;

a rotating mechanism retained within the receiving space; and a fixture to fix a solder paste jar, wherein the fixture is capable of being rotated by the rotating mechanism, and when a voltage applied to the electromagnetic member varies, the vibration member vibrates the fixture in a corresponding amplitude and frequency as attracted by the electromagnetic member and resisted by the elastic arms of the plurality of bars.

2. The solder paste mixer as described in claim 1, wherein the housing comprises a bottom plate, four side plates, cooperatively defining the receiving space, and a cover plate used to cover the receiving space.

3. The solder paste mixer as described in claim 2, wherein the housing further comprises a middle plate mounted in the receiving space and defining a through hole to allow the fixture to extend through.

4. The solder paste mixer as described in claim 2, further comprising a control panel fixed on the cover plate and electrically connected to the vibration mechanism and the rotating mechanism, wherein the control panel is used to control the operation parameters of the vibration mechanism and the rotating mechanism.

5. The solder paste mixer as described in claim 1, wherein the rotating mechanism comprises an output shaft rotatably connected to the fixture via a connecting means.

* * * * *